US007484704B2

(12) United States Patent
Schommertz

(10) Patent No.: US 7,484,704 B2
(45) Date of Patent: Feb. 3, 2009

(54) STAND FOR HOLDING POLE-SHAPED OR TRUNK-SHAPED ARTICLES, IN PARTICULAR FOR HOLDING CHRISTMAS TREES

(75) Inventor: Bernd Schommertz, Mönchengladbach (DE)

(73) Assignee: Anna-Maria Schommertz, Monchengladbach (DE)

( * ) Notice: Subject to any disclaimer, the term of this patent is extended or adjusted under 35 U.S.C. 154(b) by 0 days.

(21) Appl. No.: 11/806,677

(22) Filed: Jun. 1, 2007

(65) Prior Publication Data

US 2008/0296465 A1 Dec. 4, 2008

(51) Int. Cl.
*F16M 13/00* (2006.01)

(52) U.S. Cl. ..... 248/525; 248/523

(58) Field of Classification Search ..... 248/519, 248/523, 525, 526; 47/40.5
See application file for complete search history.

(56) References Cited

U.S. PATENT DOCUMENTS

| | | | | |
|---|---|---|---|---|
| 4,159,071 | A * | 6/1979 | Roca | 297/163 |
| 5,114,113 | A | 5/1992 | Krinner | |
| 6,877,708 | B1 | 4/2005 | Thurner | |
| 6,988,702 | B2 * | 1/2006 | Schulz | 248/525 |

FOREIGN PATENT DOCUMENTS

| | | |
|---|---|---|
| DE | 39 32 473 | 4/1991 |
| DE | 3932473 A1 | 4/1991 |
| DE | 200 07 602 | 9/2000 |
| DE | 10163338 B4 | 7/2003 |
| DE | 10220879 A1 | 8/2003 |
| DE | 102 02 891 | 12/2003 |

* cited by examiner

*Primary Examiner*—Amy J. Sterling
(74) *Attorney, Agent, or Firm*—Nixon & Vanderhye PC

(57) ABSTRACT

A stand for holding pole or trunk-shaped articles, in particular Christmas trees, comprising one or more support arrangements on the base plate for supporting and holding the retaining elements, the support arrangement comprises, for each retaining element, bearings, open transversely to the axial direction, into which the pivot pins or hollow shafts, laterally protruding over the respective retaining element, can be positioned, for fixing the pivot pins or hollow shafts of the retaining elements a thrust bearing is provided, the thrust bearing is supported, at least indirectly, on the base plate, in particular on the at least one support arrangement or on a separate retaining device connected to the base plate, and the thrust bearing is provided or formed on the interior and lower face of the housing cover and/or on a separate component underneath the interior and lower face of the housing cover.

16 Claims, 5 Drawing Sheets

Figure 1:
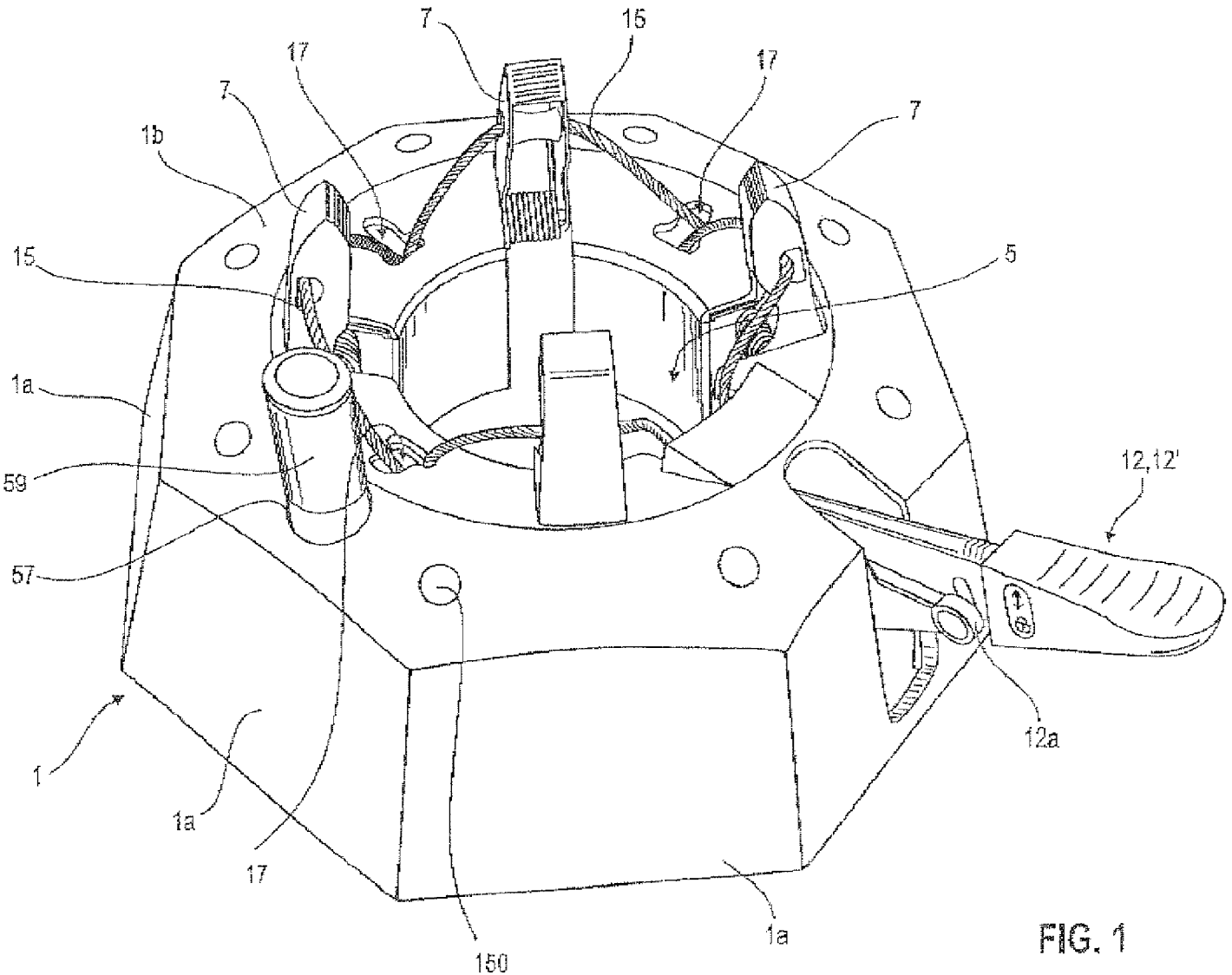

STAND FOR HOLDING POLE-SHAPED OR TRUNK-SHAPED ARTICLES, IN PARTICULAR FOR HOLDING CHRISTMAS TREES

The invention relates to a stand for holding pole-shaped or trunk-shaped articles, in particular for holding Christmas trees according to the preamble of claim 1.

A plurality of Christmas tree stands, which enable a Christmas tree to be held in a simple manner in a corresponding holding device has already become known.

For example DE 39 32 473 A1 discloses a Christmas tree stand with a receiving part, arranged on a base plate, for the trunk and a plurality of retaining elements, arranged about a symmetrical axis, which are each independently free to swivel at different levels above the receiving part between a releasing position and a fixing position. At the same time, the retaining elements are aligned in such a way that they can be pivoted at least approximately at vertical levels, which intersect the symmetrical axis of the entire device. In the fixing position a bearing region of the retaining elements is pressed against the trunk of the tree to be held. For this purpose, a clamping device is provided which, by means of a force transmission element in the form of a wire loop for example, engages all retaining elements at the same time with equal application of force and moves the retaining elements into their fixing position.

This Christmas tree stand has a receiving part, in which the lower end of the Christmas tree to be held is inserted.

The swivel arms and the adjusting device are arranged outs-de this receiving chamber. The receiving chamber itself can be filled with water, in order to prevent as far as possible needles dropping off the tree.

A cover housing with a central hole for the Christmas tree to be held can be positioned over the entire assembly.

A Christmas tree stand with a different fixing unit, which is simple to operate, is also disclosed by DE 200 07 602 U1. In accordance with this prior art Christmas tree stand, provision is made for a separate force transmission element which, as with the known Christmas tree stand mentioned initially, can be likewise operated by a clamping device, to be provided for each retaining element or group of retaining elements. A spring device is arranged at the end of each force transmission element, the spring device comprising an end detent, wherein there is a pressure-loaded spring between this and a detent guide fixed on the retaining device.

As a result of these detents fixed on the housing and/or holding device, it is ensured that—if a fixing section of a retaining element abuts against the tree stump and with further biasing of the clamping device said retaining element cannot be pivoted further—a spring device between the stationary detent and a movable detent at the end of the force transmission element is now increasingly more compressed and tensioned. In this way, travel and pressure of the retaining elements, possibly to be pivoted to a varying distance, can be balanced entirely without difficulty.

Also, with this embodiment, in the middle region of the Christmas tree stand, said receiving space is designed to hold the lower end of a Christmas tree, the retaining elements on the upper periphery of this receiving chamber being arranged outside said receiving chamber, including the associated reset spring, the operating cable, which is connected to the clamping device, etc.

A disadvantage of the embodiment described above, however, is that the effort required to set up the entire Christmas tree stand including assembly of the retaining device with the associated pivot pins, adjustment of the spring elements etc. is very laborious and therefore also time-consuming.

In accordance with DE 102 02 891 A1 a different type of reset spring device has been proposed, wherein the retaining elements are taken back to their releasing position swung outwards, if the clamping device for holding a Christmas tree is released. The retaining elements disclosed by this earlier publication comprise a so-called torsion spring, whose coil or coils surround the bearing pin of the retaining element. While one spring leg biases the retaining element in the open direction pointing outwards, the other end of the spring leg rests on a support-side detent, which is to say ultimately connected to the base side.

An object of the present invention, in contrast to this, is to create an improved Christmas tree stand for holding pole-shaped and/or trunk-shaped articles such as Christmas trees for example, which is very easy to set up and at the same time preferably has sufficient space for weighting down the Christmas tree stand and/or for supplying with water.

The object is achieved by the invention according to the features detailed in claim 1. Advantageous configurations of the invention are indicated in the sub-claims.

In the context of the present invention a Christmas tree stand is proposed, which although it has optimal handling, simple-to-operate retaining elements etc., is very easy to set up.

The Christmas tree stand according to the invention comprises a base plate or a base carrier with support arrangements, which preferably comprise half-shell bearings for the pins of the retaining elements. Here, the pivotable retaining elements with the pre-mounted reset spring device can be fitted without aids. To finally fix these retaining elements only a cap, covering everything, must be fitted and secured with bolts preferably from underneath the base plate. This cap, that is to say the housing cover (which also has a central hole in the middle for inserting the trunk to be held, a Christmas tree for example) on its inside comprises a thrust bearing, which covers the top side of the pin stub, protruding laterally over the retaining elements, and secures the respective associated bearing of the pin.

Alternatively or in addition to this, it is also possible that the inside of the housing cover does not directly secure the pins of the retaining elements, but other securing means are provided here, which preferably cover and lock the upper half of the respective pins of the retaining elements, the housing interior in the installed condition preferably then fixing these securing means and as a result the pins of the pivotable retaining elements being positioned and held in the correct position, so that the securing means themselves do not have to be fixed independently, in order to lock the pins of the retaining elements. Thus, the securing means, for example in the form of an all-round hoop with corresponding retaining sections, for partially seating and fixing the pins of the retaining elements preferably serve simply as an intermediate ring, which is secured by the ultimately fitted cap or cover housing.

It has also proved particularly advantageous if the base plate can be provided with a circular housing wall arranged very far outside (with a smaller recess cut out in the vicinity of the clamping device). The entire support arrangement for mounting and positioning the retaining elements as well as for guiding the clamping means can then be fitted inside on corresponding wall constructions, column-type elevations etc., resting on the base plate, linked together with the advantage that virtually the entire interior can be flooded with water. Thus, stability is not only substantially improved, but also a sufficiently large water reservoir is created, in order for example to supply the Christmas tree, to be held, with sufficient water to prevent the tree from drying out too quickly and from beginning to drop needles.

Figure 2:
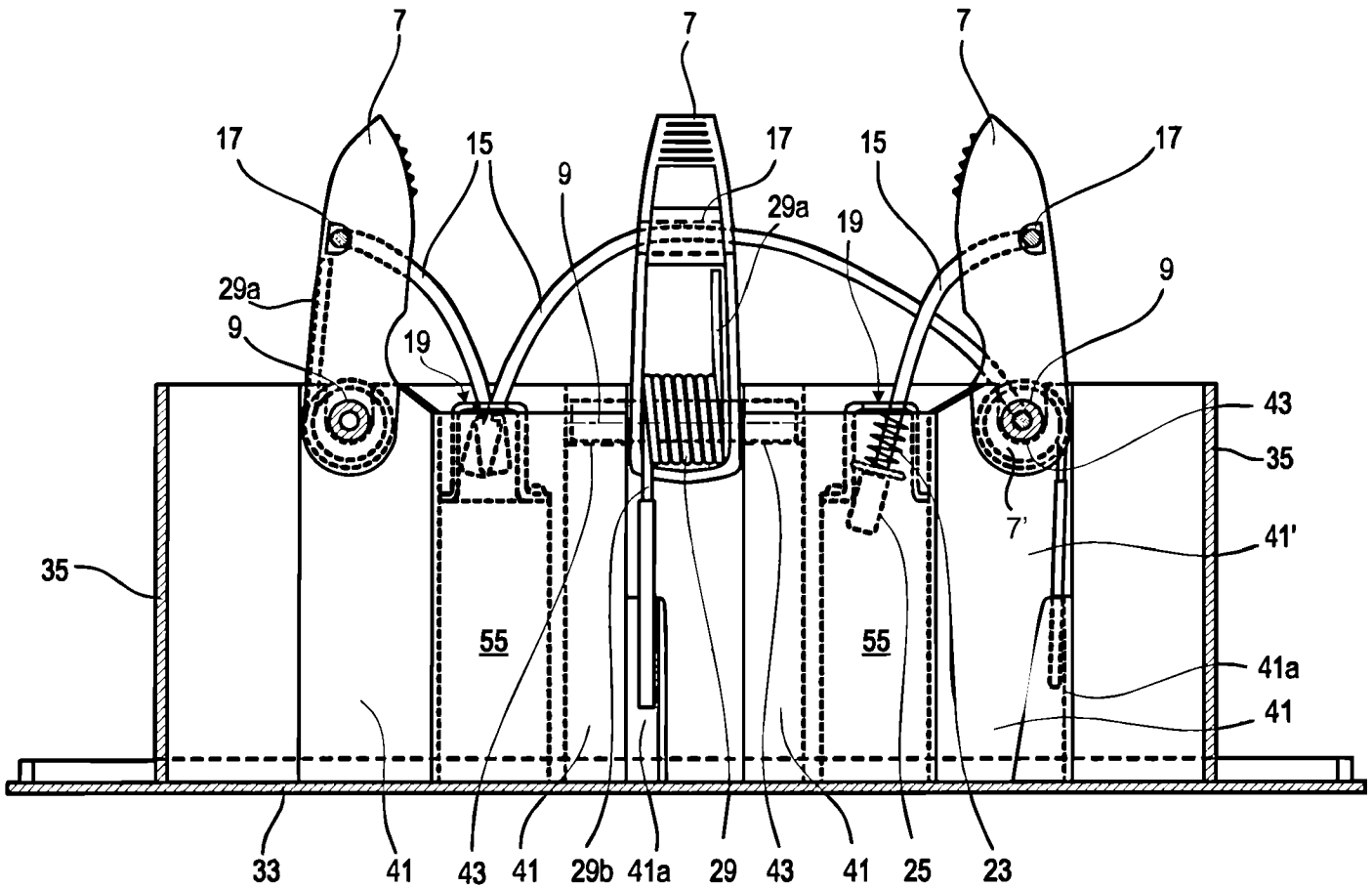
Figure 3A:
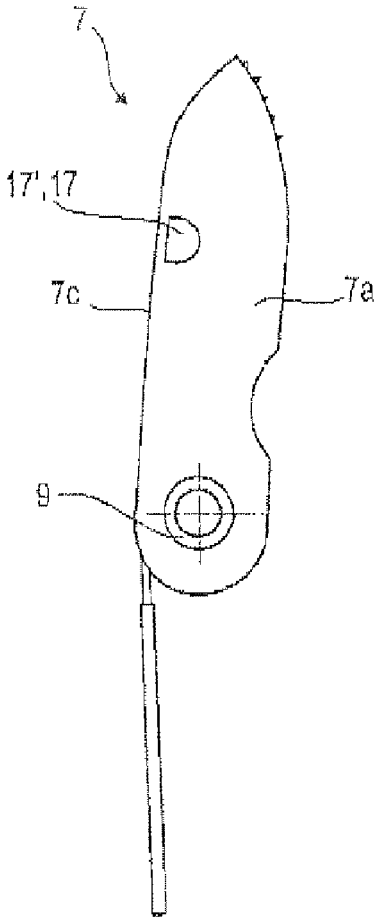
Figure 3B:
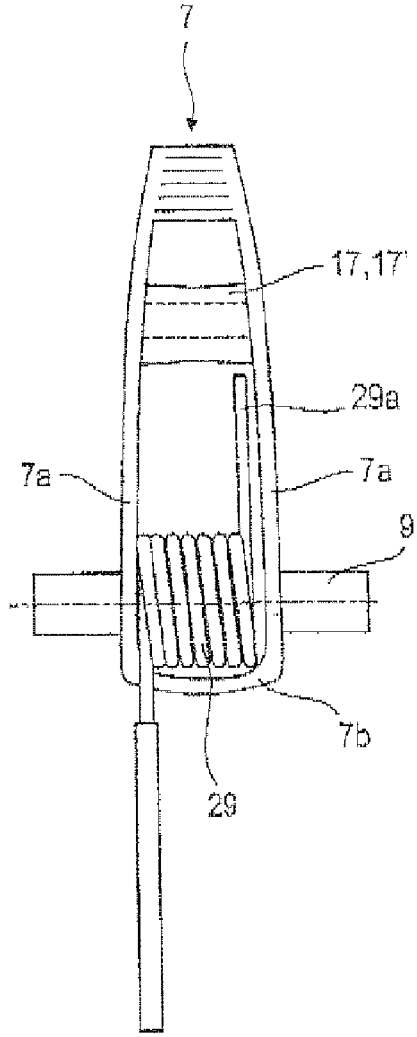
Figure 3C:
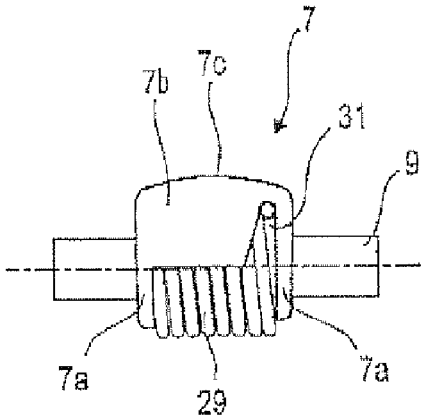
Figure 4:
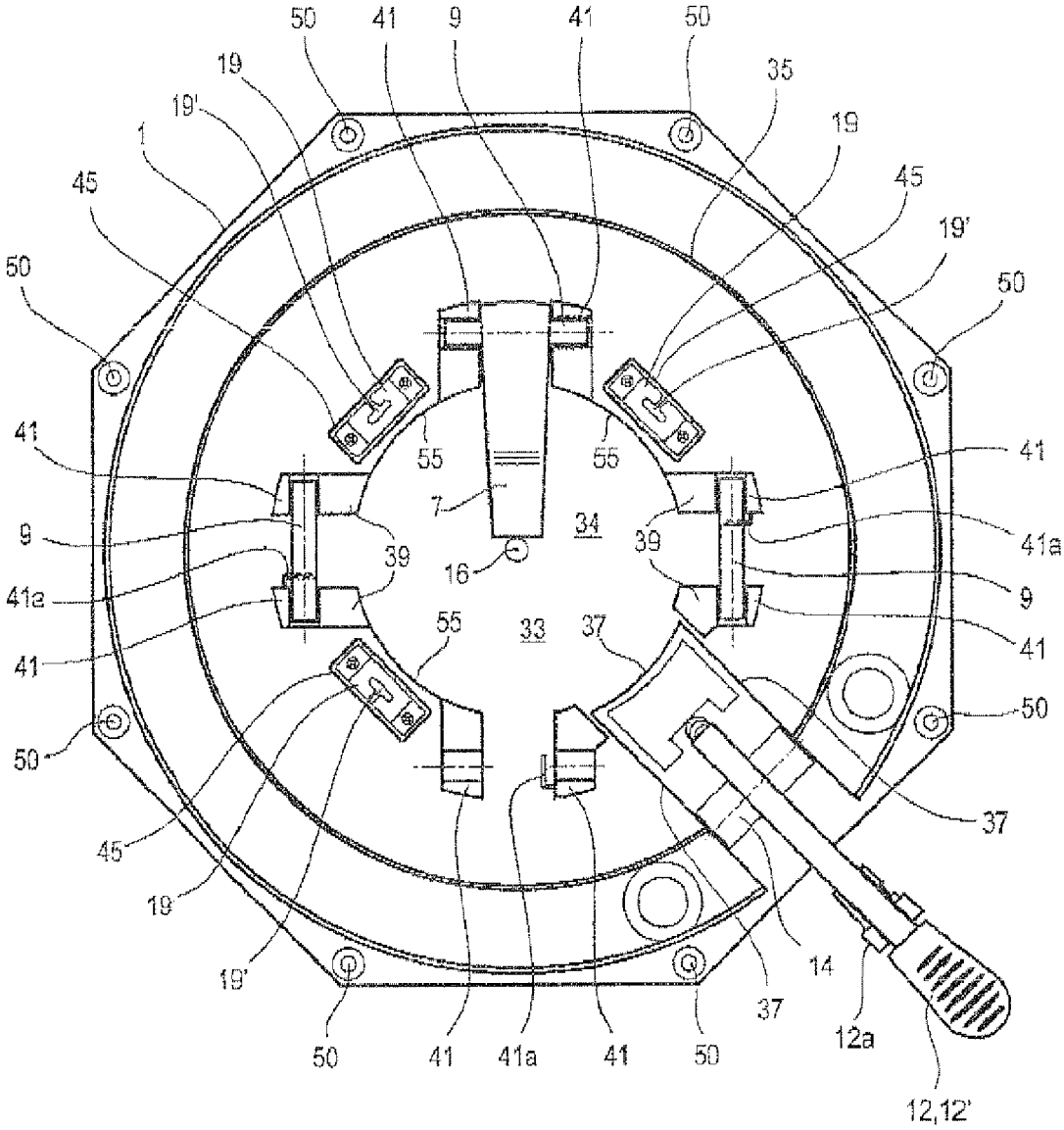
Figure 5:
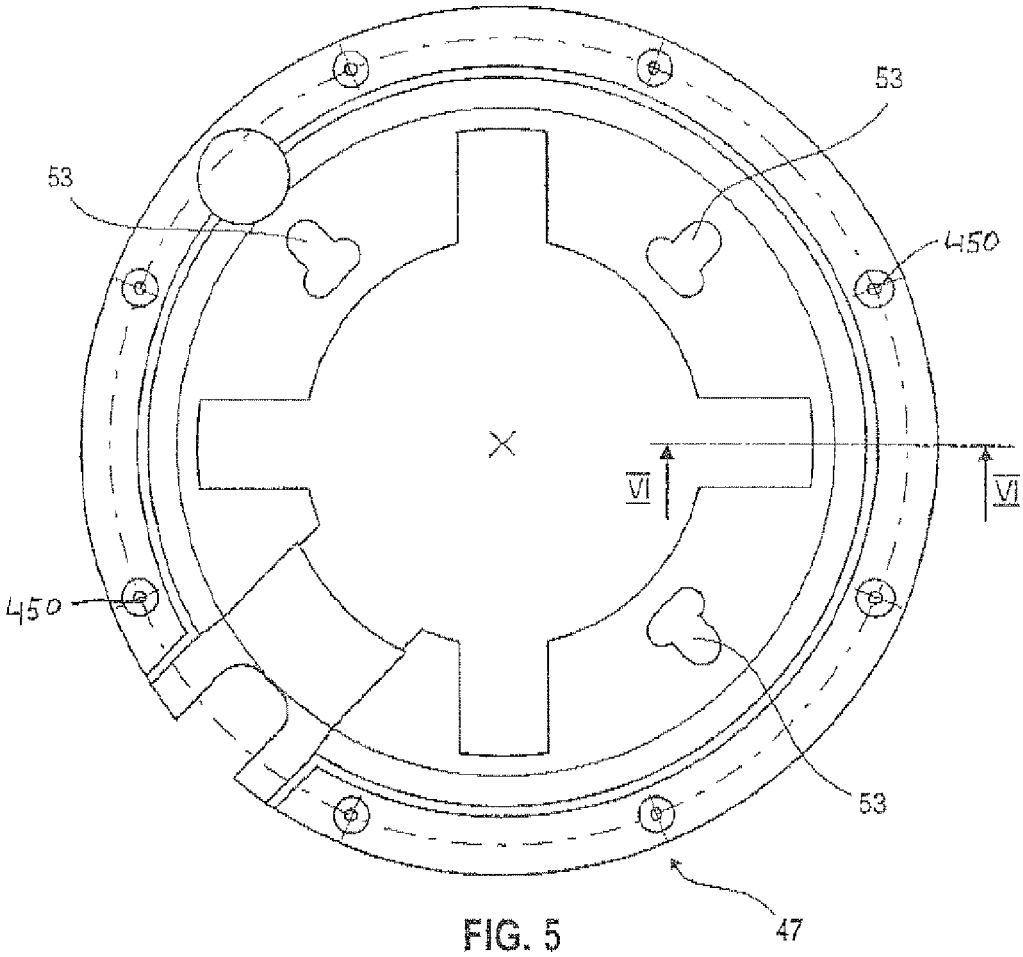

Further advantages, details and features of the invention will be evident below from exemplary embodiments illustrated on the basis of drawings, which show in detail:

FIG. 1: a schematic 3D illustration of the Christmas tree stand according to the invention with housing cover fitted;

FIG. 2: a schematic extract-wise cross sectional illustration perpendicular to the base plate approximately through the centre of the holding device shown on FIG. 1;

FIGS. 3*a* to 3*c*: a side view, an interior view and a view from below of a pivotable lever equipped with a coil spring;

FIG. 4: a schematic top view onto the Christmas tree stand shown on FIG. 1 with housing cover and snap ring removed;

FIG. 5: a schematic top view onto the snap ring, located below the housing cover, for fixing the pivot pins or hollow shafts of the retaining elements, and FIG. 6: an extract-wise cross sectional illustration through the snap ring along line VI-VI on FIG. 5.

On FIG. 1 the stand, which is also described below as a Christmas tree stand, is shown in a perspective illustration.

Here, a housing cover 1 with an all-round side wall 1*a* and a top side 1*b* sloping rather upwards is shown. The side panels 1*a* have an almost trapezoidal shape in the exemplary embodiment shown, said side panels 1*a* being slightly inclined to the middle.

In the centre on the top side 1*b* an opening 5 is to be seen, into which the lower end of a trunk or post to be held, for example a Christmas tree can be inserted.

In the exemplary embodiment shown, four retaining levers, also subsequently called retaining elements 7, are arranged offset to one another, in the circumferential direction, which are designed by means of a pivot axle 9, still to be described later, aligned substantially horizontally, in the form of pivot pins or hollow shafts.

Furthermore, a clamping device 12, comprising a clamping lever 12', which can also be pivoted about a substantially horizontal clamping lever axle 14, is to be seen. Such a clamping device 12 normally comprises a ratchet mechanism, in order to tension the retaining elements 7 from their open position shown on FIG. 1 into a biased position abutting against the outer periphery of a tree trunk to be held. The ratchet device can be released by a release lever 12*a* on the clamping device and the clamping lever can be again moved to its initial position, the individual retaining elements being moved to their open position pivoted outwards to release an inserted trunk.

In order to bias the retaining elements 7 accordingly, a separate tautening cable 15 in the exemplary embodiment shown runs from the clamping device 12 to each retaining element 7, said tautening cable 15 passing through an opening 17 in the respective retaining element 7, above the associated pivot axle 9, and with its free end supported indirectly on a detent guide 19.

As more exactly shown by the following drawings, a spring device 23 (FIG. 2) is provided at the end of each of these force transmission elements 151, for example in the form of the tautening cables 15 mentioned, through which the respective tautening cable 15 runs as far as an end detent 25. Preferably, a further support assembly, for example in the form of a ring disk (not illustrated) which rests on the lower face of a slot-shaped connection guide 19 is provided on the sides of the spring device 23 facing the end detent 25.

Thus, an assembly results, as known in principle from DE 200 07 602 U1, to whose disclosure content reference is made.

If namely the clamping device 12 is moved to the closed position, the tautening cables 15 leading to the individual retaining elements 7 are shortened and thus the top-lying bearing sections 7' of the retaining elements 7 are moved substantially to the middle of the holding device while rotating about the axles 9, thus approximately at vertical levels, which intersect a vertical central axis 16, running through the stand.

If the retaining elements 7 come to abut against the outer periphery of the tree one after the other due to an asymmetrical tree periphery, the clamping device can continue to be operated, wherein the levers, whose bearing section 7' already lies on the outer periphery of the tree, are moved further and the aforementioned spring force device of the spring device 23 is compressed, possibly until the full spring travel is exhausted.

A pivotable retaining element 7 with integrated reset spring 29 is illustrated on FIG. 3*a* in schematic side view, on FIG. 3*b* in schematic frontal view and on FIG. 3*c* in schematic view from below.

Each retaining element 7 in this case can pivot about said pin or said hollow shaft 9, these pins or these hollow shafts 9 preferably being firmly connected to the lever and being able to be pivoted with this.

The lever is U-shaped in cross section and has two side bars 7*a*, between which the channel 17', identified as opening 17, runs lying on top, through which the respective tautening cable 15 passes for manipulating the retaining element 7.

Said reset spring 29 is provided as a coil spring between the two side bars 7*a* on the pivot pins or hollow shaft 9 running through inside the coil spring, one spring leg 29*a* under bias abutting against the inside of the retaining element 7 between the two side bars 7*a* and the other spring leg 29*b* protruding in the opposite direction. In this case—as is evident in the view from below on FIG. 3*c*—an approximately V-shaped recess 31 is cut from the material of the retaining element 7 in the vicinity of a base section 7*b* (running between the two side bars 7*a*), which turns into the rear wall section 7*c* and which connects the two side bars 7*a*. Since a resetting force is introduced by the reset spring, the upper spring leg 29*a* lying in the retaining element 7 and the downward protruding spring leg 29*b*, when viewed from the side on FIG. 3*a*, in each case try to rotate further to the left, wherein the downward-protruding spring leg 29*b* lies in the V-shaped recess 31 then limited by the detent, thus as a result defining a maximum open position of the retaining element 7 related to its lower spring leg 29*b*, as this is shown for example by the side view on FIG. 3*a*.

In the illustration on FIG. 4 in plan view and on FIG. 2 in schematic cross sectional view it can be seen that the stand comprises a base plate 33, which is connected integrally and closely to an all-round external wall 35 or is formed integrally for example by injection moulding. This external wall 35 can run substantially in the shape of a bell. An inwardly projecting bulge 37, which accommodates the clamping lever device 12 with the associated ratchet device etc. including the pivot axle of the clamping device, is provided only in the vicinity of the clamping lever device. Above all, as a consequence a receiving chamber 34, very large in dimension, is created since—also still to be discussed in detail below—the entire inner space surrounded by the external wall 35 can be flooded and the columns or towers 41 still to be discussed below as well as the elevation 45 for mounting the detent guide 19 rest saliently on the base plate and are arranged, as it were, as islands inside the receiving chamber 34. Because, especially through the pairs of towers or columns 41, still to be discussed below, which each hold a lever, a free space is created, by means of which the innermost lying space is connected to the spacer seen radially, outside the levers and can be jointly flooded with water.

Inwardly lying offset to this external wall a further support arrangement is provided for the retaining elements 7 as well as the detent guide 19 for the force transmission element 15', preferably configured in the form of tautening cables 15.

This support arrangement 39 in each case comprises a pair of columns or towers 41, lying offset in the circumferential direction, rectangular if anything in cross section, whose lateral distance is such that the pivotable retaining elements 7 can be positioned in between.

Said columns or towers 41 in this case on their top side preferably have half-shell bearings 43, which are dimensioned so long in the axial direction and outwardly limited such that in each case a retaining element 7 with the associated pivot hollow shafts 9 can be inserted here.

As also indicated on the figures, a detent 41*a*, against which the spring leg 29*b* projecting downwards can be supported, is formed at least on an inside 41' in each case of a pair of columns or towers 41 for mounting a pivotable retaining element 7.

In the start position (that is to say open position) the individual pivotable retaining elements 7 assume approximately the position if anything vertically-aligned shown on FIG. 3*a* or FIG. 2, in which because of the reset spring no further pivot movement of the pivot lever can take place outwardly, since the downward-protruding spring leg 29*b* in the V-shaped limit detent 31 abuts against the lower base section 7*b* of the retaining element 7. As previously mentioned a tautening cable 15, which is taken through the opening 17, that is to say the channel 17' through the respective clamping lever above its pivot axle 9 and terminates at a side facing the clamping device 12, on the associated retaining element 7 to an associated detent guide 19, leads from the clamping device 12 to each clamping lever and to be precise due to the fact that said spring device 23 is hung on the end of the associated clamping cable behind a slot-shaped detent guide 19.

The respective tautening cable 15, which leads to the retaining element 7 lying further away, seen from the clamping device 12, is routed so that it firstly passes through the pivot axle of the lever element 7 concerned, lying nearer the clamping device, formed as pivot hollow shaft 9, in order then to be led through the corresponding channel-shaped opening 17 in the pivot lever lying further away and become supported on a detent guide 19, exactly diametrically facing the clamping lever 12', on which the other tautening cable 15 routed counterclockwise for the second lever, lying further away, is likewise supported.

Said detent guides 19 are likewise formed on column or tower-shaped elevations 45 or plateaus 45, the top side of the column or tower-shaped elevations 45 being able to terminate below the upper end of the columns or towers 41. Said detent guide 19 is then screwed preferably, in side view, as a kind of inverted U on the column or tower-shaped elevations 45, whose slot recess formed on the top side for hanging the end of the cables approximately at the height, where the upper end of the columns or towers 41 seating the pins or hollow shafts 9 also terminates.

For assembly, only the correspondingly prepared retaining elements 7 with their axles and with their reset spring 29 must be fitted on the half-shell bearings 43 concerned of the columns or towers 41 and the corresponding clamping levers 15 prepared and provided with the spring device at the end. In this case, the two retaining elements 7, lying further away from the clamping lever, once on the right and once on the left, seen from the clamping device, are routed through said pivot hollow shaft 9 of the retaining element 7 concerned lying nearer the clamping device 12.

In order to lock the retaining elements 7, in the exemplary embodiment shown, a snap ring 47 is fitted, which on the one hand is supported against the external wall 35 and on the other hand against the columns or towers 41 for the retaining elements 7. This snap ring 47, has on its lower face, correspondingly counter-shaped, that is to say, likewise preferably half-shell or semi-pocket cylindrical recesses 48, which come to lie exactly where the corresponding pivot pins or pivot hollow shafts 9 of the retaining elements 7 protrude upwards from the lower half-shell bearings 43 on the columns or towers 41.

Said snap ring 47 therefore also serves as a reinforcing hoop 47. It is additionally held by the inside of the housing cover and preferably can be attached thereto. As a result, the axles of the clamping levers 30 can be held and locked with sufficient force. In this case, the housing cover can be screwed to the base plate, in order thereby to keep the axles 9 of the retaining elements 7 secure. Alternatively or additionally, the snap ring 47 can be attached alone or together, for example by means of bolts, to the housing cover at internal anchorage points, such as for example the columns or towers or additional wall sections, held by means of the base plate, or additional support arrangements. Also, snap-in and/or adhesive connections are possible.

Figure 6:
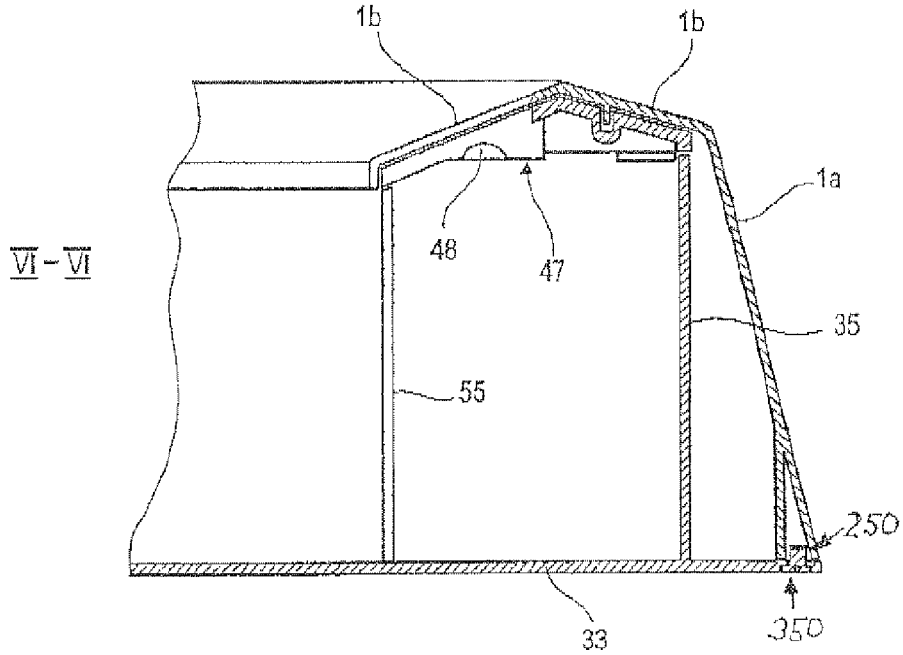

On FIG. 5 said snap ring is shown here from above and on FIG. 6 in a cross sectional illustration along line VI-VI on FIG. 5.

Therefore, the pivot pins and/or hollow shafts 9 are locked, as a result of which the retaining elements 7 are also held in this position.

Now, only said housing cover 1 must still be fitted, wherein in the exemplary embodiment shown this housing cover on the lower edge, lying offset in each case, has a drilled hole 250, which is aligned with corresponding drilled holes 50 in the base plate 33. These drilled holes 50 are provided in the corner areas of the base plate 33, arranged octagonally seen from above. Bolts 350 for example can then be screwed from below, through the drilled hole 50 in the base plate 33, into a corresponding recess 250 on the lower periphery of the housing cover 1, in order to firmly connect the housing cover 1 to the base plate 33.

Additional bolts are also provided on the top side 1*b*, and to be precise in the outer all-round section, which adjoins the side panels 1*a* running substantially at least approximately perpendicularly. As can be seen from the illustration on FIG. 1, here bolts 150, which penetrate corresponding drilled holes in the housing cover 1 and are supported there, are screwed in from above. The respective bolt shaft in this case is screwed each time into a drilled hole 450 on the outer periphery of the snap ring 47, aligning with the corresponding drilled hole in the housing cover 1, whereby the snap ring 47 on the inner wall of the housing cover 1 is firmly connected to this. In other words, the snap ring 47 can be firmly attached by said bolts initially on the inside of the housing cover, in order to then cover the entire housing cover on the adjustment mechanism and the adjusting levers while overlapping the outside all-round wall 35. Bolts 150 are only indicated on FIG. 1, since the drilled hole, in which the respective head of the bolts 150 lies, is covered by caps inserted into the openings.

Now, bolts can therefore be screwed into the drilled holes 50 into the housing cover 1 from below, that is to say from underneath the base plate 33 through said drilled holes 50 in the base plate, so that said snap ring 47 is held and secured without play on the inner face of the top side 1*b* of the housing cover 1 by means of the housing cover 1, thus in other words pressed downwards, so that the retaining elements 7 are firmly locked in this position by means of the pivot axle 9.

Now, only the corresponding ends of said tautening cables 5 with their spring force device must be hung in the detent guides 19, located directly underneath, which are plate-shaped and provided with a T-shaped slot 19', through corresponding openings 17 in the top side 1*b* of the housing cover 1 and the openings 53 located directly underneath, which are provided in the snap ring 47. By means of this T-shaped slot the respective tautening cable 15 can be inserted into the crossbeam form of the T-shaped slot, so that the spring device 23 of the tautening cable end can rest on its lower face.

As is also evident from the assembly described, in each case one half of a pair of columns or towers 41 for mounting a retaining element 7 with in each case a column or tower 51, initially lying in the circumferential direction, of an adjacent pair of columns or towers for a next retaining element 7, is connected to a corresponding wall section 55, partially circular when seen from above, which can also be connected to the column or tower-shaped elevation 45 for the detent guide 19. Since, however, the space in each case between a pair of columns or towers 41 is completely free, it is ensured that the entire interior running up to and including the external wall 35 can be filled with water.

Due to the additionally provided drilled holes 57, a water level gauge 59 at which the level of the water can be easily read off from outside can also be incorporated.

However, deviating from the exemplary embodiment shown, a loop-shaped force transmission device 15 can also be provided with a tautening cable, formed only with one loop, whose two ends can be tightened by the clamping device, or which has a fixed end and only the other free end can be tightened by means of the clamping device. This tautening cable can be routed around all pivot levers 7, as is disclosed in principle by DE 39 32 473 C2. The invention, therefore, is not limited to a certain variant, in order to produce the necessary clamping forces for the pivot levers.

The invention claimed is:

1. A stand for holding pole or trunk-shaped articles comprising:

a base plate, a housing cover that defines a housing interior therein, a receiving chamber arranged on the base plate, plural retaining elements, lying offset about a central and/or symmetrical axis of the receiving chamber, which are each pivotable between a fixing and a releasing position about a horizontal pivot axle or about a pivot axle with a horizontal component, at least one clamping device, including at least one force transmission element, in the form of one or more tautening cables, lead to the respective retaining elements in order to pivot the retaining elements towards one another in the fixing position direction, a reset spring device, that biases the retaining elements in the releasing position, the retaining elements being structured to swing into the releasing position when the clamping device is opened, one or more support arrangements on the base plate supporting and holding the retaining elements, the support arrangement comprising for each retaining element, bearings, open transversely to the axial direction, into which pivot pins or hollow shafts, laterally protruding over the respective retaining element, can be positioned, a thrust bearing for fixing the pivot pins or hollow shafts of the retaining elements, which covers and locks the opening region of the bearings with the corresponding section of the pivot pin or hollow shaft and, the thrust bearing being supported, at least indirectly, on the base plate, on the at least one support arrangement or on a separate retaining device connected to the base plate, and the thrust bearing being provided or formed on the interior and lower face of the housing cover and/or on a separate component underneath the interior and lower face of the housing cover, wherein holes are provided on the top side of the housing cover, for firmly attaching at least one snap ring present within the housing interior to the housing cover.

2. The stand according to claim 1, wherein the thrust bearing consists of a snap ring, which is provided with corresponding recesses for housing the corresponding sections of the pivot pins or hollow shafts.

3. The stand according to claim 1, wherein the bearings for the pivot pins or hollow shafts of the retaining elements are fitted on the top side of columns, towers or elevations, which rise from the base plate or are supported thereby.

4. The stand according to claim 1, wherein the bearings are of semi-cylindrical design and are open at least with one component upwards and in that the semi-cylindrical recesses, formed on the thrust bearing and/or on the snap ring, with the opening side or with a component of their opening side point downwards and in the installed condition form a cylindrical receiving space for corresponding sections of the pivot pins or hollow shafts.

5. The stand according to claim 1, wherein a pair of columns or towers is arranged offset to one another in the circumferential direction and supports a retaining element.

6. The stand according to claim 1, wherein two columns or towers, lying adjacent to one another, of two adjacent retaining elements are each connected to one another by means of a common wall section, a wall section arranged partially circular when seen from above.

7. The stand according to claim 1, wherein an all-round closed external wall is connected to the base plate which, inwardly lying offset to this, surrounds the support arrangement with columns and/or towers.

8. The stand according to claim 1, wherein the entire interior can be filled within the external wall with water.

9. The stand according to claim 1, wherein the columns or towers are formed as island-shaped elevations in the interior circumscribed by the all-round external wall.

10. The stand according to claim 1, wherein a force transmission element, in the form of a tautening cable, whose end is supported by means of a spring device on a detent guide, proceeds from the clamping device to a retaining element or to groups of a plurality of retaining elements in each case.

11. The stand according to claim 1, wherein only one force transmission element, in the form of a tautening cable, proceeds from the clamping device and leads to a plurality of, all retaining elements, so that these, while producing a uniform force distribution, can be pressed against the outer periphery of a trunk or pole to be held.

12. The stand according to claim 8, wherein the detent guide is provided on a higher-lying column or tower-shaped elevation facing the base plate.

13. The stand according to claim 1, wherein a housing cover is provided covering the entire base plate with the external wall and equipped with an open region for receiving a trunk or pole to be held.

14. The stand according to claim 13, wherein the housing cover can be connected, screwed to the base plate.

15. The stand according to claim 1, wherein said holes provided on the top side of the housing cover are drilled, by means of which bolts can be or are screwed in, as a result of which the at least one snap ring present within the housing interior is firmly connected to the housing cover.

16. A stand for holding pole or trunk-shaped articles comprising:

a base plate, a housing cover that defines a housing interior therein, a receiving chamber arranged on the base plate, plural retaining elements, lying offset about a central and/or symmetrical axis of the receiving chamber, which are each pivotable between a fixing and a releasing position about a horizontal pivot axle or about a pivot axle with a horizontal component, at least one clamping device, including at least one force transmission element, in the form of one or more tautening cables, lead to the respective retaining elements in order to pivot the retaining elements towards one another in the fixing position direction, a reset spring device, that biases the retaining elements in the releasing position, the retaining elements being structured to swing into the releasing position when the clamping device is opened, one or more support arrangements on the base plate supporting and holding the retaining elements, the support arrangement comprising for each retaining element, bearings, open transversely to the axial direction, into which pivot pins or hollow shafts, laterally protruding over the respective retaining element, can be positioned, a thrust bearing for fixing the pivot pins or hollow shafts of the retaining elements, which covers and locks the opening region of the bearings with the corresponding section of the pivot pin or hollow shaft and, the thrust bearing being supported, at least indirectly, on the base plate, on the at least one support arrangement or on a separate retaining device connected to the base plate, and the thrust bearing being provided or formed on the interior and lower face of the housing cover and/or on a separate component underneath the interior and lower face of the housing cover, wherein the bearings are of semi-cylindrical design and are open at least with one component upwards and in that the semi-cylindrical recesses, formed on the thrust bearing and/or on the snap ring, with the opening side or with a component of their opening side point downwards and in the installed condition form a cylindrical receiving space for corresponding sections of the pivot pins or hollow shafts.

* * * * *